US005242243A

United States Patent [19]

Bachelier

[11] Patent Number: 5,242,243

[45] Date of Patent: Sep. 7, 1993

[54] FLOATING BREAKWATER DEVICE

[76] Inventor: Franklin E. Bachelier, 1243 Bittersweet Rd., P.O. Box 123, Lake Ozark, Mo. 65049

[21] Appl. No.: 20,214

[22] Filed: Feb. 19, 1993

[51] Int. Cl.[5] ..... E02B 3/06

[52] U.S. Cl. ..... 405/26; 405/23; 405/63; 405/70

[58] Field of Search ..... 405/21, 23, 26, 27, 405/28, 63, 70, 71, 72

[56] References Cited

U.S. PATENT DOCUMENTS

| | | | |
|---|---|---|---|
| 151,858 | 6/1874 | Dean | 405/27 |
| 3,353,361 | 11/1967 | Lloyd . | |
| 3,487,645 | 1/1970 | Frankel . | |
| 3,952,521 | 4/1976 | Potter | 405/27 |
| 3,953,977 | 5/1976 | Kikui et al. | 405/27 |
| 3,969,901 | 7/1976 | Matsudaira et al. | 405/26 X |
| 4,027,486 | 6/1977 | Dougherty . | |
| 4,225,268 | 9/1980 | Treu | 405/27 |
| 4,234,266 | 11/1980 | Angioletti . | |
| 4,264,233 | 4/1981 | McCambridge . | |
| 4,300,856 | 11/1981 | Magoon | 405/70 X |
| 4,748,338 | 5/1988 | Boyce . | |
| 4,768,896 | 9/1988 | Moore | 405/26 |

FOREIGN PATENT DOCUMENTS

| | | |
|---|---|---|
| 58-65811 | 4/1983 | Japan . |
| 58-138806 | 8/1983 | Japan . |

OTHER PUBLICATIONS

Floating Dock Drawing, Construction Products, Inc. Jan. 1981.

Floating Dock Catalog Page, United Flotation Systems, 1984.

Marinas—A Working Guide to Development and Design, Don W. Adie, Architectural Press, 3rd Edition 1984, pp. 18, 19 and 183-195.

*Primary Examiner*—David H. Corbin

*Attorney, Agent, or Firm*—Lee, Mann, Smith, McWilliams, Sweeney & Ohlson

[57] ABSTRACT

A floating breakwater device for attenuating waves includes an elongated frame extending vertically between an upper end and a lower end. A buoyant member is attached to the frame to support the top end of the frame above the water surface. A barrier is attached to the frame which extends downwardly from the top end of the frame and below the water surface to a position adjacent the bottom end of the frame. The barrier is adapted to intercept and reflect a portion of the kinetic energy of an attacking wave. A first platform and a second platform are attached to the bottom end of the frame on opposite sides. The platforms extend outwardly from the frame to provide stability and resistance to unwanted movement of the breakwater device. A chamber may be removably attached to the bottom end of the frame to be selectively filled with mass such that the chamber provides additional stability and resistance to unwanted movement of the breakwater device and to be selectively filled with a gas such that the chamber is operative to float on the water surface thereby rotating and floating the frame horizontally on the surface of the water to facilitate maintenance of the breakwater device. Inertial masses may be removably attached to the breakwater device to provide additional stability and resistance to unwanted movement.

19 Claims, 4 Drawing Sheets

FLOATING BREAKWATER DEVICE

BACKGROUND OF THE INVENTION

The present invention is directed to floating breakwater devices and in particular breakwater devices which attenuate the destructive forces of waves and reflect a portion of the kinetic energy of an attacking wave.

The breakwater device is intended for deployment as a floating wind and boat wake wave attenuator. The breakwater may be deployed on the waters of lakes, bays or oceans for the purpose of providing wave protection for marinas and other small craft harbors.

A body in water has six degrees of freedom or modes of motion including three translatory modes (surge, sway and heave) and three rotational modes (roll, yaw and pitch). For a breakwater device to be effective in blocking the transmission of wave energy, the breakwater is preferably held in a relatively steady upright position. The present invention provides control over three of the modes of motion, namely, surge or movement seaward and leeward, heave or vertical motion, and roll or rocking motion about a longitudinal axis. The remaining modes of motion including sway, pitch and yaw are modified or dampened by the breakwater device.

SUMMARY OF THE INVENTION

The present invention is a floating breakwater system including a plurality of breakwater devices for attenuating the destructive forces of waves and for intercepting and reflecting a portion of the kinetic energy of attacking waves. Each breakwater device includes an elongate frame extending vertically between an upper end and a lower end. Flotation members such as foam plastic blocks are attached to the frame at the upper end to provide a buoyant force such that the top end of the frame projects above the water surface to provide a desired amount of freeboard. A reflective barrier is attached to the frame which extends downwardly from the top end of the frame and below the water surface to a position adjacent the bottom end of the frame. The barrier is preferably rigid and substantially nonperforate such that the barrier will intercept and reflect a portion of the kinetic energy of attacking waves to maintain the water on the leeward side of the breakwater device relatively calm. The buoyant member may form a portion of the reflective barrier.

A first platform and a second platform are attached to the bottom end of the frame. The first and second platforms are located on opposite sides of the frame and extend outwardly from the bottom end of the frame such that the first and second platforms and the reflective barrier form a generally inverted T-shaped cross section. The platforms are substantially nonperforate and provide stability and resistance to unwanted movement of the breakwater device.

One or more inertial masses may be attached to the frame or to the platforms in various different locations as desired to provide additional mass and resistance to movement of the breakwater device. A hollow chamber may be attached to the bottom end of the frame. The chamber may be selectively filled with water or other substances to provide additional mass and stability and resistance to unwanted movement of the breakwater device. The chamber may also be selectively filled with a gas such as air whereby the chamber will float on the water surface and the frame will extend horizontally at the water surface to facilitate inspection and maintenance of the breakwater device. The chamber may be selectively removed and replaced on the breakwater device. A flexible web which is substantially nonperforate may be attached to one or both ends of the reflective barrier to provide for the attachment of the breakwater device to an adjacent breakwater device or to any other adjacent structure. The flexible web diminishes the transmission of wave flow between adjacent breakwater devices.

DESCRIPTION OF THE PREFERRED EMBODIMENT

Figure 1:
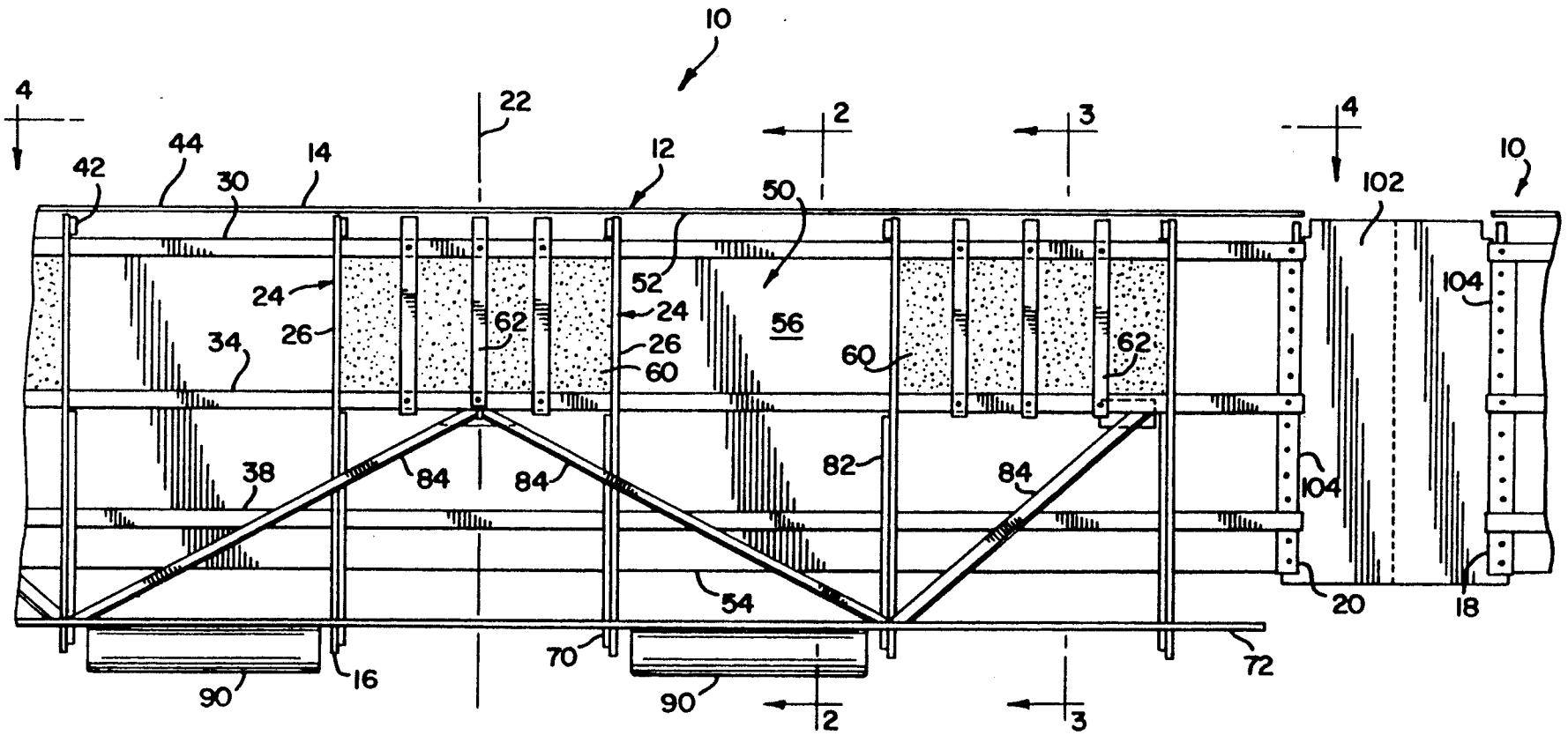
FIG. 1 is a side elevational view of the floating breakwater device of the present invention shown attached to an adjacent breakwater device.

The floating breakwater device 10 generally shown in FIG. 1 includes a frame 12. The frame 12 extends substantially vertically between an upper end 14 and a lower end 16 and longitudinally between a left end 18 and a right end 20. The breakwater device 10 is generally symmetrical about a central vertical axis 22 and may be made of treated wood, steel, concrete, reinforced plastic or other structural materials.

Figures 2, 3:
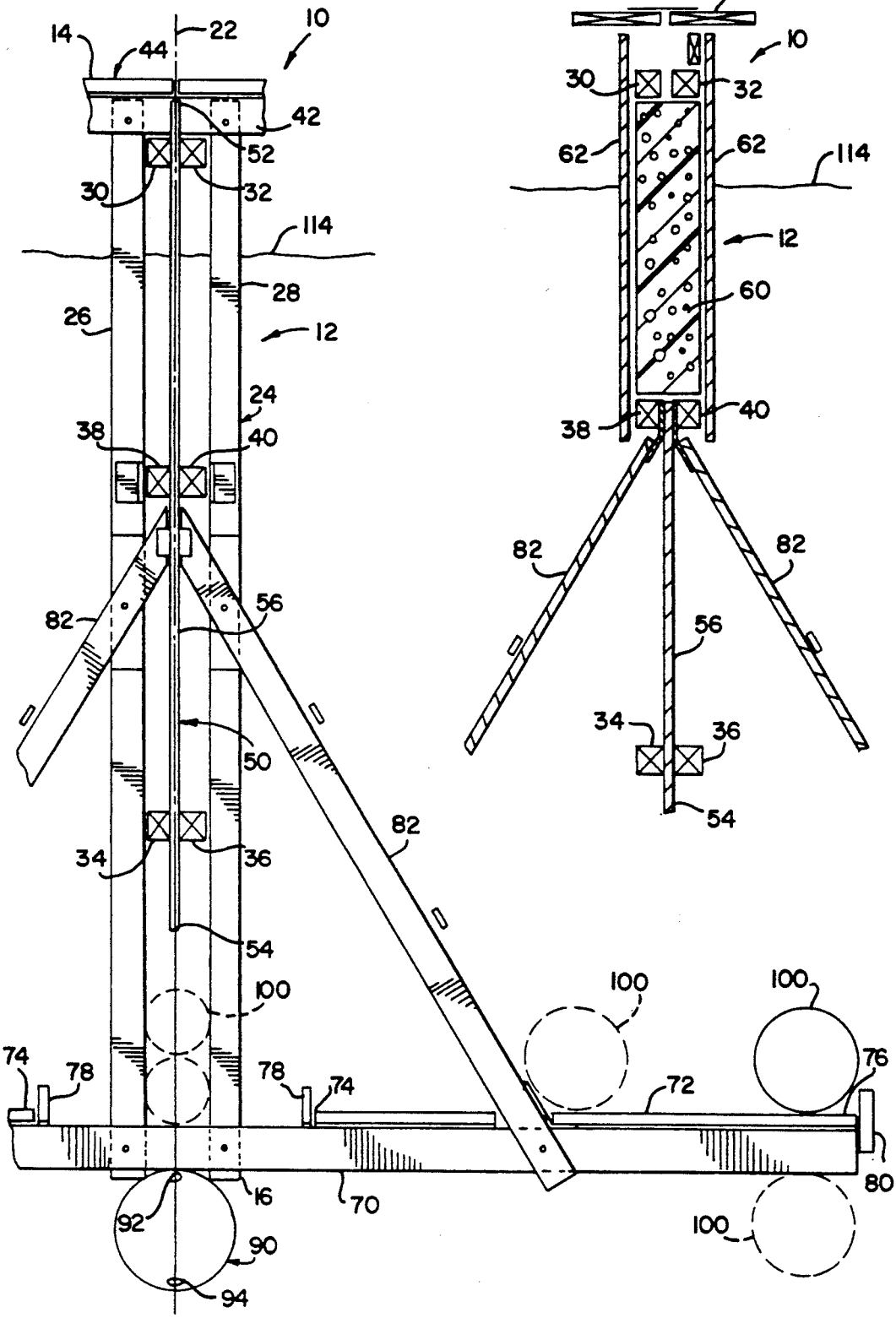
FIG. 2 is a cross sectional view taken along lines 2—2 of FIG. 1.
FIG. 3 is a cross sectional view taken along lines 3—3 of FIG. 1.
Figure 4:
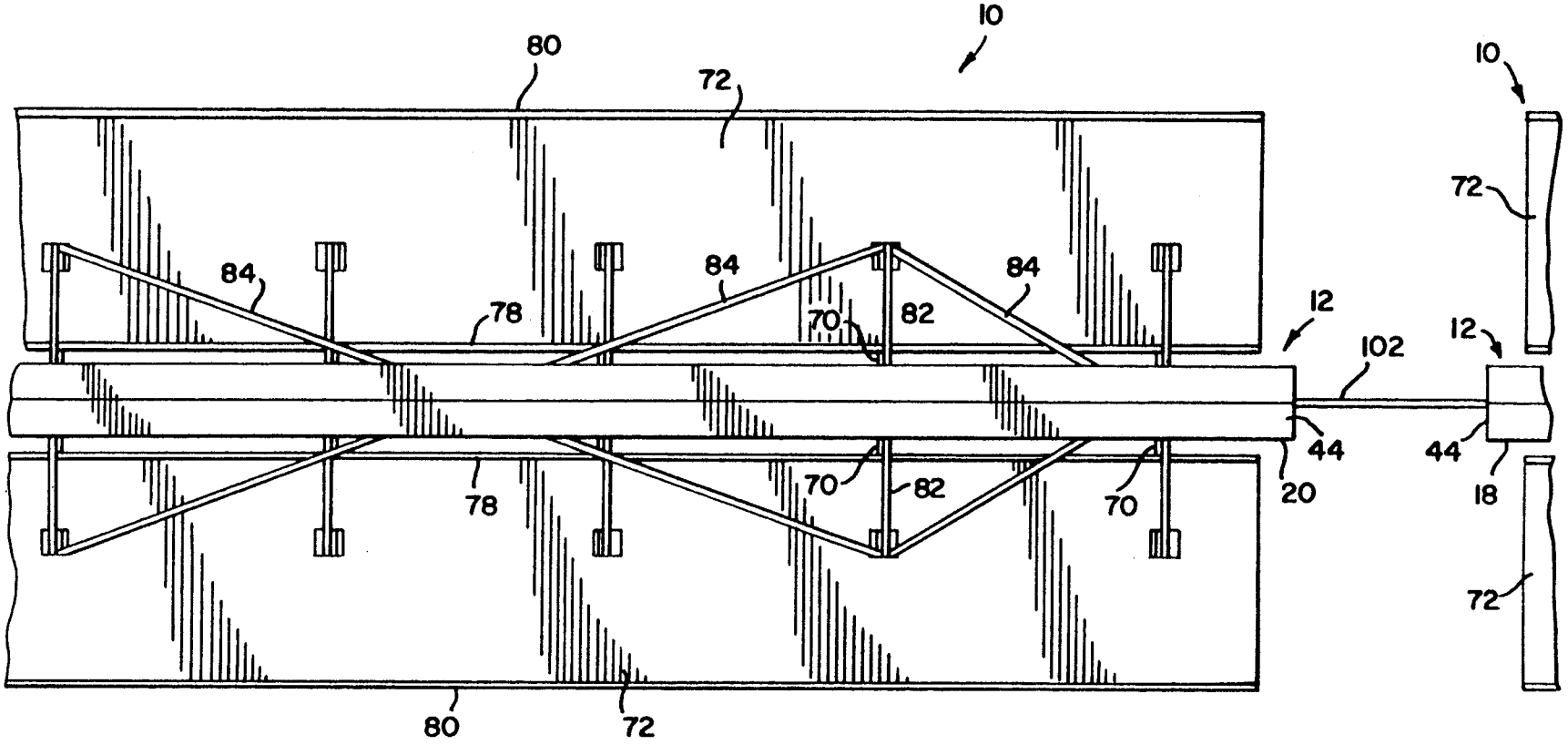
FIG. 4 is a plan view of the breakwater device taken along lines 4—4 of FIG. 1.

The frame 12 includes a plurality of substantially vertical columns 24 which are spaced apart from one another along the longitudinal length of the breakwater device 10. Each column 24 includes a first post 26 and a second post 28 as best seen in FIG. 2. The posts 26 and 28 are spaced apart from one another in a direction transverse to the length of the breakwater device 10. Longitudinal framing elements such as a first top rail 30 and a second top rail 32 extend generally horizontal and substantially the entire length of the breakwater device 10 between the left end 18 and the right end 20 of the frame 12. The top rail 30 is connected to the upper end of the posts 26 and is located between the posts 26 and 28. The top rail 32 is connected to the upper end of the posts 28 and is located between the posts 26 and 28. The top rail 32 is spaced apart from and extends parallel to the top rail 30.

Longitudinal framing elements such as a first bottom rail 34 and a second bottom rail 36 extend generally horizontal and parallel to the top rails 30 and 32 between the left end 18 and the right end 20 of the frame 12 and are located between the posts 26 and 28. The bottom rails 34 is connected to the posts 26 in proximity to the lower end 16 of the frame 12. The bottom rail 36 is connected to the posts 28 in proximity to the lower end 16 of the frame 12 and is spaced apart from and extends parallel to the bottom rail 34.

Longitudinal framing elements such as a first intermediate rail 38 and a second intermediate rail 40 extend generally horizontal and parallel to the top rails 30 and 32 between the posts 26 and 28. The intermediate rail 38 is connected to the posts 26 between the top rail 30 and bottom rail 34. The intermediate rail 40 is attached to the posts 28 between the top rail 32 and the bottom rail 36. The intermediate rail 40 is spaced apart from and extends parallel to the intermediate rail 38. Various different types of fastening mechanisms such as bolts and nuts or nails may be used to connect the rails 30, 32, 34, 36, 38 and 40 to the posts 26 and 28 or in suitable circumstances they may be welded, monolithically cast or otherwise bonded and made to act as an integral structural unit. The rails 30, 32, 34, 36, 38 and 40 may each include one or more segments and need not be continuous.

A cross brace 42 extends between and is connected to the upper ends of the posts 26 and 28 at each column 24. A deck 44 is attached to the cross braces 42 at each column 24 and extends between the left end 18 and the right end 20 of the frame 12. The deck 44 may be formed by two or more planks or similar elements to provide transverse structure forming a walkway along the upper end 14 of the frame 12.

A barrier 50 is attached to the frame 12. The barrier 50 is generally nonperforate, rigid and planar and extends from an upper end 52 located in proximity to the upper end 14 of the frame 12 downwardly to a lower end 54 which is located adjacent the lower end 16 of the frame 12. The lower end 54 of the barrier 50 may be spaced various different distances from the lower end 16 of the frame 12 as desired. The barrier 50 extends substantially continuously between the left end 18 and the right end 20 of the frame 12. The barrier 50 includes a sheet-like member 56 which may have a relatively small thickness, for example three-quarter inch, relative to its height or length, for example thirty-six feet. The sheet-like member 56 is generally planar, rigid and nonperforate and may be formed from plywood, plastic or metal sheeting or other materials.

The barrier 50 may also include one or more flotation members 60 spaced at alternate positions along the length of the barrier 50 as best seen in FIG. 1. The flotation member 60 may be made of blocks of buoyant foam material such as polystyrene plastic, from vertical or horizontal air-tight tanks, or other materials or devices which provide a buoyant force sufficient to keep the deck 44 and a portion of the barrier 50 above the water level.

As best shown in FIGS. 1 and 3, the flotation members 60 extend vertically between the top rails 30 and 32 and the intermediate rails 38 and 40 and extend horizontally between alternate adjacent columns 24. The flotation member 60 may extend the entire length of the frame 12 or a plurality of flotation members 60 may be located along the length of the frame 12 in various different locations as desired. A plurality of vertical slats 62 are shown in FIG. 1 extending between and attached to the top rails 30 and 32 and the bottom rails 34 and 36 on each side of the flotation member 60 to secure the flotation member 60 to the frame 12. The flotation members 60 may form a portion of the barrier 50 or may be separate.

The sheet-like member 56 extends continuously between the left end 18 and the right end 20 of the frame 12. As best shown in FIG. 2, the sheet-like member 56 extends from an upper edge located adjacent the upper end 14 of the frame 12 downwardly to a lower edge located in proximity to the lower end 16 of the frame 12. The sheet-like member 56 is located between and is connected to the rails 30, 32, 34, 36, 38 and 40. As shown in FIG. 3, in those areas of the frame 12 where a flotation member 60 is located, the sheet-like member 56 extends downwardly from the bottom end of the floatation member 60 to a position located adjacent the lower end 16 of the frame 12 as shown in FIG. 2. The sheet-like member 56 and the flotation member 60 combine to create a substantially nonperforate reflective barrier through the frame 12 as shown in FIG. 1.

As best shown in FIG. 2, a strut 70 is attached to the bottom end of the posts 26 and 28 of each column 24 and extends horizontally and generally transversely from the frame 12. In the preferred embodiment, the breakwater device 10 includes two platforms 72, but only one platform 72 may be used if desired. In the preferred embodiment a platform 72 is attached to the strut 70 on each side of the frame 12. Each platform 72 extends generally the entire length of the breakwater device 10 between the left end 18 and the right end 20 of the frame 12. However, a plurality of platforms 72 having various different lengths as desired may be used on each side of the frame 12 such that gaps are formed between adjacent platforms 72 on one side of the frame 12 if economy or reduction of shadow and environmental impact becomes important. Each platform 72 includes an inner edge 74 which is located adjacent to the frame 12 and an outer edge 76 located at an end of the strut 70. The platforms 72 are substantially planar, rigid and are preferably substantially nonperforate. The length of the strut 70 and the widths of the platform 72 between the inner edge 74 and the outer edge 76 may be varied as desired and as warranted by design considerations. Each platform 72 may also include an inner flow restrictor 78 located along the inner edge 74 which extends vertically above the upper surface of the platform 72. Each platform 72 may also include an outer flow restrictor 80 attached to the outer edge 76 of the platform 72 and which extends vertically above the upper surface of the platform 72. The flow restrictors 78 and 80 may be made of plates or planks.

As shown in FIG. 2, the breakwater device 10 may also include one or more knee braces 82. Each knee brace 82 is connected at the upper end to the midportion of a post 26 or 28 of a column 24 and at the lower end to the strut 70 at a location spaced apart from the frame 12. A knee brace 82 may be located on both sides of a column 24 or only on one or the other side. In addition the knee braces 82 may be located at only one or more preselected columns 24. The knee braces 82 reinforce the breakwater device 10 to prevent relative movement between the platforms 72 and the barrier 50. In those cases where the connection between the barrier 50 and the platforms 72 is sufficiently strong, the knee braces 82 may be eliminated. As shown in FIG. 2, the platforms 72 may include small apertures where the knee brace 82 extends through the platform 72.

As best shown in FIG. 1, the floating breakwater device 10 may include diagonal braces 84 which are attached at one end to the frame 12 and at the other end to the platform 72 and a strut 70. The arrangement of the diagonal bracing 84 and the number of diagonal braces 84 utilized may be varied to sufficiently stiffen the breakwater device 10 as desired. The diagonal braces 84 may be eliminated in those cases where the breakwater device 10 is sufficiently rigid without them.

As best shown in FIGS. 1 and 2, one or more hollow chambers 90 such as a tank may be removably attached to the lower end 16 of the frame 12. The chambers 90 may be of various different sizes, diameters and lengths as desired. When filled with water or some ballast material such as sand the chambers 90 function to provide stability and to resist unwanted movement of the breakwater device. Each chamber 90 includes an inlet valve 92 and an outlet valve 94. When the chamber 90 is filled with water, compressed air or other gases may be fed into the chamber 90 through the inlet valve 92 which forces the water within the chamber 90 out of the chamber 90 through the outlet valve 94 to create a gas filled chamber 90. When the chamber 90 is filled with gas, the inlet valve 92 and the outlet valve 94 may be opened to permit the introduction of water into the chamber 90 and the removal of the gas within the chamber through the valve 92. This gas filled chamber, when the breakwater device 10 is tilted to either the right or left from the position shown in FIG. 1, will cause the tank 90 to rise to the water surface while rotating the breakwater device 10. This rotated position is helpful when maintenance operations are required on the breakwater device 10.

Inertial masses 100, as shown in FIG. 2, may be removably attached to the breakwater device 10 to add stability and resist unwanted movement. The inertial masses 100 may be dead weights made of concrete, masonry, stone, metal or any other material having a specific gravity greater than that of water or entrained water masses such as capped plastic, metal or concrete pipe filled with water or any other structure or shape which encapsulates a desired volume of water. One or more inertial masses 100 may be located on top of the strut 70 between the posts 26 and 28 of the column 24. The inertial masses 100 may also be removably attached to the top of the platform 72 at various different locations as desired or may be removably attached to the strut 70 as illustrated by the dotted line configurations shown in FIG. 2. The number, size and location of the inertial masses 100 may be varied as desired.

As best shown in FIG. 1, adjacent breakwater devices 10 may be connected to one another by a substantially nonperforate flexible membrane 102. Each vertical edge 104 of the membrane 102 is connected to a respective breakwater device 10. The membrane 102 extends from the upper end 14 of the frame 12 downwardly to the lower end 54 of the barrier 50.

Figure 5:
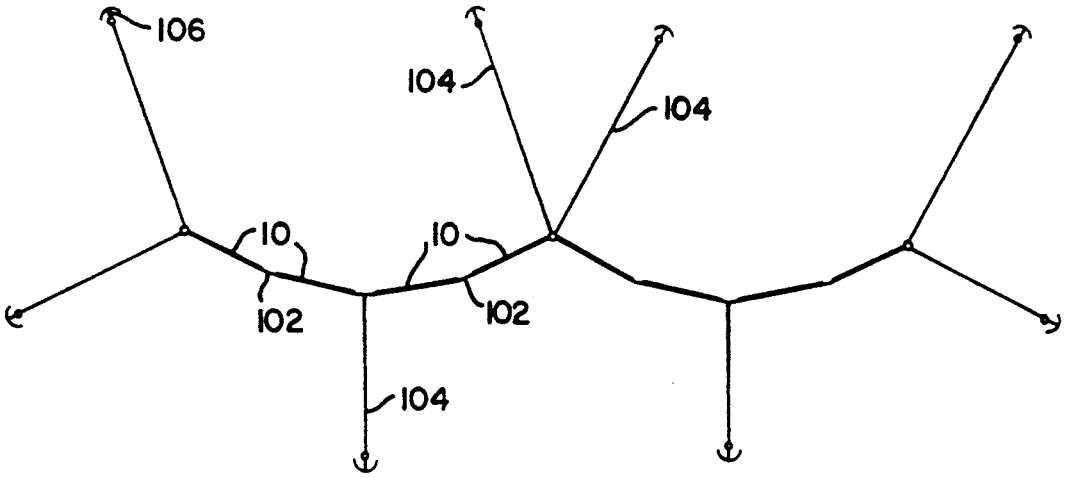
FIG. 5 is a schematic illustration in a plan view of one method of deploying the breakwater device wherein a plurality of breakwater devices are attached in an end-to-end manner.
Figure 6:
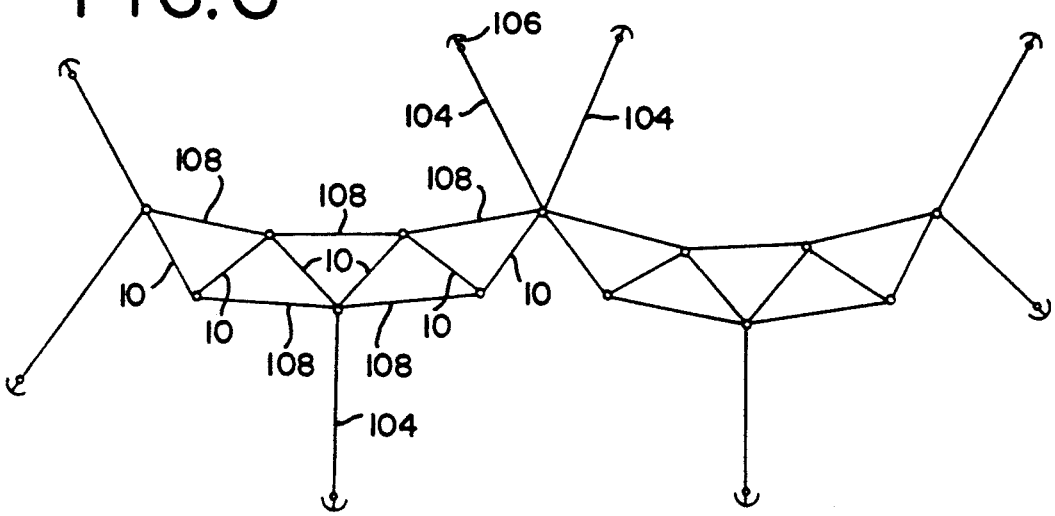
FIG. 6 is a schematic illustration of a plan view of a second method of deploying the breakwater device wherein a plurality of breakwater devices form the diagonal members of a truss.
Figure 7:
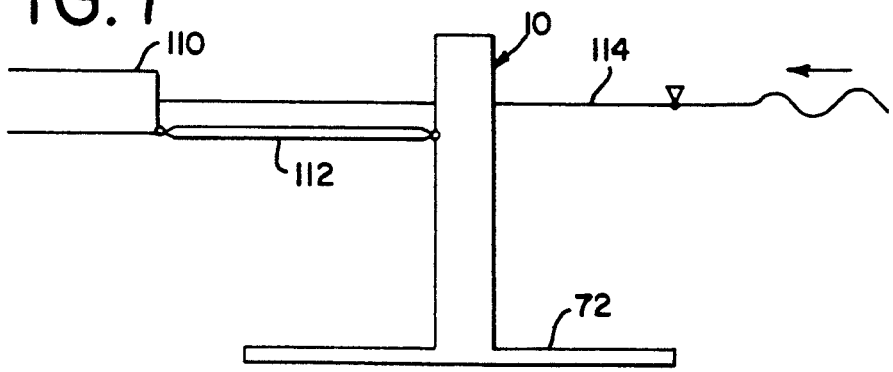
FIG. 7 is a schematic illustration in a side view of a third method of deploying the breakwater device wherein the breakwater device is attached to an existing structure.

FIGS. 5–7 schematically illustrate various different methods for interconnecting and anchoring one or more breakwater devices 10 to form the breakwater system. As shown in FIG. 5, a plurality of breakwater devices 10 are interconnected end to end in a string in the form of a catenary. This catenary deployment of the breakwater devices 10 is held in place by conventional chain or cable mooring lines 104 which are connected at one end to the breakwater devices 10 at convenient locations and which are connected at the opposite end to a stationary anchor 106.

FIG. 6 shows a plurality of breakwater devices 10 deployed in the form of a trussed net catenary. In this arrangement the breakwater devices 10 form the diagonal members of the truss which are under compression and the chords, which are under tension from forces generated by the sea and/or anchoring arrangement, are formed by a tension member 108 such as chain, wire rope or similar devices. This deployment method is favored for use in heavier seas and under circumstances which provide constant oblique angles of attack by waves or strongly directional seas.

As shown in FIG. 7, the breakwater device 10 may also be deployed in close proximity to an existing structure 110 for example a pier, by the use of one or more rigid stand-off spars 112. The spars 112 are hingedly connected at one end to the structure 110 and are hingedly connected to the breakwater device 10 at the opposite end. The spars 112 permit vertical and roll movement of the breakwater device 10 while substantially prohibiting any horizontal movements in sway or yaw.

In operation, one or more breakwater devices 10 may be deployed as a floating wind and boat wake wave attenuator. The substantially vertical barrier 50 and the substantially horizontal platforms 72 create an inverted T-shaped structure. The substantially nonperforate and substantially vertical barrier 50 extends a sufficient distance above and below the water to intercept oncoming waves and reflect and/or transform a portion of an attacking wave's energy.

For the barrier 50 to be the most effective in blocking the transmission of wave energy beyond the breakwater device 10 and maintain a calm water surface in a harbor or marina, it is preferable that the reflective barrier 50 be held in a relatively steady upright position. This is accomplished in part by the horizontal platforms 72. Locating the platforms 72 at some depth below the water surface 114 minimizes the magnitude of wave induced orbital trajectories of the water particles and their consequent forces on the breakwater device 10. The platforms 72 dampen wave induced vertical motions with the creation of a water mass located about the platforms 72 which is prevented from freely flowing beyond or through the platforms 72. The effectiveness of the platforms 72 in creating an added water mass which is prevented from freely flowing beyond the platforms 72 is enhanced by the addition of flow restrictors 78 and 80 as the edges of the platforms 72.

The longitudinal and torsional rigidity of the breakwater device 10 dampens the device's response to short crested waves and waves attacking at an oblique angle to the reflective barrier 50. One or more movable inertial masses 100 may be positioned and connected to the breakwater device 10 in various locations as desired. The masses 100 resist wave induced pitch as the masses 100 increase the rotary inertia of the breakwater device 10. The platforms 72 and masses 100 of the breakwater device 10 also provide additional rotary inertia to dampen roll motions.

The center of mass (in air) of the breakwater device 10 is generally located near the intersection of the frame 12 and the strut 70. To maintain a relatively large metacentric height, the flotation members 60 of the breakwater device 10 are placed in the upper part of the frame 12. The flotation members 60 must provide sufficient buoyancy to carry the submerged weight of the breakwater device 10 including any additional weight provided by the attachment of inertial masses 100, marine growth and any downward force induced by the mooring lines 104. In addition, sufficient reserve buoyancy should be provided to insure an adequate freeboard of the barrier 50 above the water surface 114 to minimize overtopping during storms or other rough weather or wave conditions (boat wakes). To minimize the upward or heave forces on the breakwater device 10 which would result in vertical movement, the flotation members 60 are oriented such that a minimum of the flotation member's cross-section penetrates the water surface 114 thereby providing a small water-plane area.

The narrow plan width of the breakwater device 10 at the water surface 114 minimizes intrusion into harbor space. The shadow cast on the bottom of a body of water is often used as a measure of environmental impact. The form of the breakwater device 10 minimizes any environmental impact and provides a desirable habitat for marine life. The breakwater device 10 includes a narrow frame 12 and a narrow reflective barrier 50 and the width and length of the platforms 72 may be adjusted to minimize its shadow as needed while the stability of the breakwater device 10 is maintained through use of various different inertial masses 100 as needed. The breakwater device 10 will therefore have minimal environmental impact.

Corrosion and other forms of deterioration are an unavoidable consequence of placing structures in water. To accommodate ease of maintenance, the breakwater device 10 may include one or more floodable chambers 90 removably attached at the lower end 16 of the frame 12. The chamber 90 may be selectively filled with air to provide buoyancy and will float to the surface such that the breakwater device 10 will lie on its side when tipped such that the frame 12 extends generally horizontal at the water surface 114. In addition, the chamber 90 may be flooded with water to provide additional mass to the breakwater device 10 to prevent unwanted movements. The chambers 90 may be removed and replaced on the breakwater device 10 such that chambers 90 may be attached to the breakwater device 10 only when maintenance and inspection is desired. Thus a single chamber 90 may service many different breakwater devices 10.

The flexible membrane 102 may be used to connect adjacent breakwater devices 10 to one another and permits some longitudinal and transverse movement of the breakwater devices 10 relative to one another while blocking wave energy from passing between adjacent breakwater devices 10. Various navigation lights or other markings may be attached to the breakwater device 10 to warn boaters of the presence of the breakwater and to prevent damage.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A floating breakwater device for attenuating the energy transmitted by waves comprising:

an elongate frame extending vertically between an upper end and a lower end;

means attached to said frame for providing a buoyant force such that said top end of said frame projects above the water surface;

barrier means attached to said frame, said barrier means extending downwardly from said top end of said frame below the water surface toward said bottom end of said frame and extending substantially continuously longitudinally from one end of said frame to the other end, said barrier means adapted to intercept and reflect a portion of the kinetic energy of an oncoming wave; and at least one platform attached to said bottom end of said frame extending horizontally outwardly from said bottom end of said frame to provide stability and resistance to unwanted movement of said breakwater device.

2. The floating breakwater device of claim 1 including a first platform attached to said bottom end of said frame and a second platform attached to said bottom end of said frame, said first and second platforms extending outwardly from said bottom end of said frame.

3. The floating breakwater device of claim 1 wherein said buoyant means comprises foam plastic blocks.

4. The floating breakwater device of claim 3 wherein said foam plastic blocks are made of polystyrene.

5. The floating breakwater device of claim 1 wherein said buoyant means comprises a hollow enclosure.

6. The floating breakwater device of claim 1 wherein said barrier means is substantially nonperforate.

7. The floating breakwater device of claim 1 wherein said barrier means is rigid.

8. The floating breakwater device of claim 1 wherein said buoyant means comprises a portion of said barrier means.

9. The floating breakwater device of claim 1 wherein said platform is substantially nonperforate.

10. The floating breakwater device of claim 1 including a first flow restrictor extending upwardly from an outer edge of said platform.

11. The floating breakwater device of claim 10 including a second flow restrictor extending upwardly from an inner edge of said platform.

12. The floating breakwater device of claim 1 including a chamber attached to said bottom end of said frame.

13. The floating breakwater device of claim 12 wherein said chamber comprises a hollow tank.

14. The floating breakwater device of claim 13 wherein said chamber is adapted to be filled with mass such that said chamber provides stability and resistance to unwanted movement of said breakwater device.

15. The floating breakwater device of claim 13 wherein said hollow tank includes means for selectively filling said tank with gas.

16. The floating breakwater device of claim 15 wherein said hollow tank is operative to cause said device to rotate about its longitudinal central axis such that said tank floats on the surface of the water when said tank is filled with gas thereby floating said frame horizontally on the surface of the water to facilitate maintenance of said breakwater device.

17. The floating breakwater device of claim 1 including one or more inertial masses attached to said frame to add stability and resist unwanted movement of said device.

18. The floating breakwater device of claim 1 including connector means attached to an end of said frame, said connector means providing for the attachment of said floating breakwater device to an adjacent structure.

19. The floating breakwater device of claim 18 in which said connector means includes a flexible web.

* * * * *